US007749571B2

(12) United States Patent
Chartrel

(10) Patent No.: US 7,749,571 B2
(45) Date of Patent: Jul. 6, 2010

(54) DEVICE AND METHOD FOR COATING

(75) Inventor: Jean-Francois Chartrel, Cuts (FR)

(73) Assignee: Bostik Findley S.A., Puteaux (FR)

( * ) Notice: Subject to any disclaimer, the term of this patent is extended or adjusted under 35 U.S.C. 154(b) by 1487 days.

(21) Appl. No.: 10/882,102

(22) Filed: Jul. 1, 2004

(65) Prior Publication Data

US 2005/0037142 A1 Feb. 17, 2005

(30) Foreign Application Priority Data

Jul. 1, 2003 (FR) ..... 03 07969

(51) Int. Cl.
*B05D 3/12* (2006.01)
*B05D 1/28* (2006.01)
*D06C 3/00* (2006.01)

(52) U.S. Cl. ..... 427/428.01; 427/171; 427/176; 427/177; 427/179; 427/428.08; 427/428.14; 118/603; 118/400; 118/407; 118/409; 118/420

(58) Field of Classification Search ..... 427/171–176, 427/428.01, 428.08, 428.14; 118/400, 407, 118/409, 413, 414, 419, 420
See application file for complete search history.

(56) References Cited

U.S. PATENT DOCUMENTS 2,620,767 A 12/1952 Lehman
3,486,482 A 12/1969 Hunger
3,891,785 A * 6/1975 Zemlin ..... 427/359
3,936,549 A * 2/1976 Kohler et al. ..... 427/348
4,554,886 A * 11/1985 Carter ..... 118/42
5,820,935 A * 10/1998 Kashiwabara et al. ..... 427/359
5,876,792 A * 3/1999 Caldwell ..... 427/171
6,565,660 B1 5/2003 Haubrok et al.

FOREIGN PATENT DOCUMENTS

JP 11047655 2/1999

OTHER PUBLICATIONS

Patent Abstracts of Japan vol. 1999, No. 05, May 31, 1999.

* cited by examiner

*Primary Examiner*—Timothy H Meeks
*Assistant Examiner*—Cachet I Sellman
(74) *Attorney, Agent, or Firm*—Millen, White, Zelano & Branigan, P.C.

(57) ABSTRACT

The invention relates to a coating device (10) comprising a coating tank (21) with an opening (22) and a coating roll (31), in which the roll (31) faces the opening (22).

Figure 1:
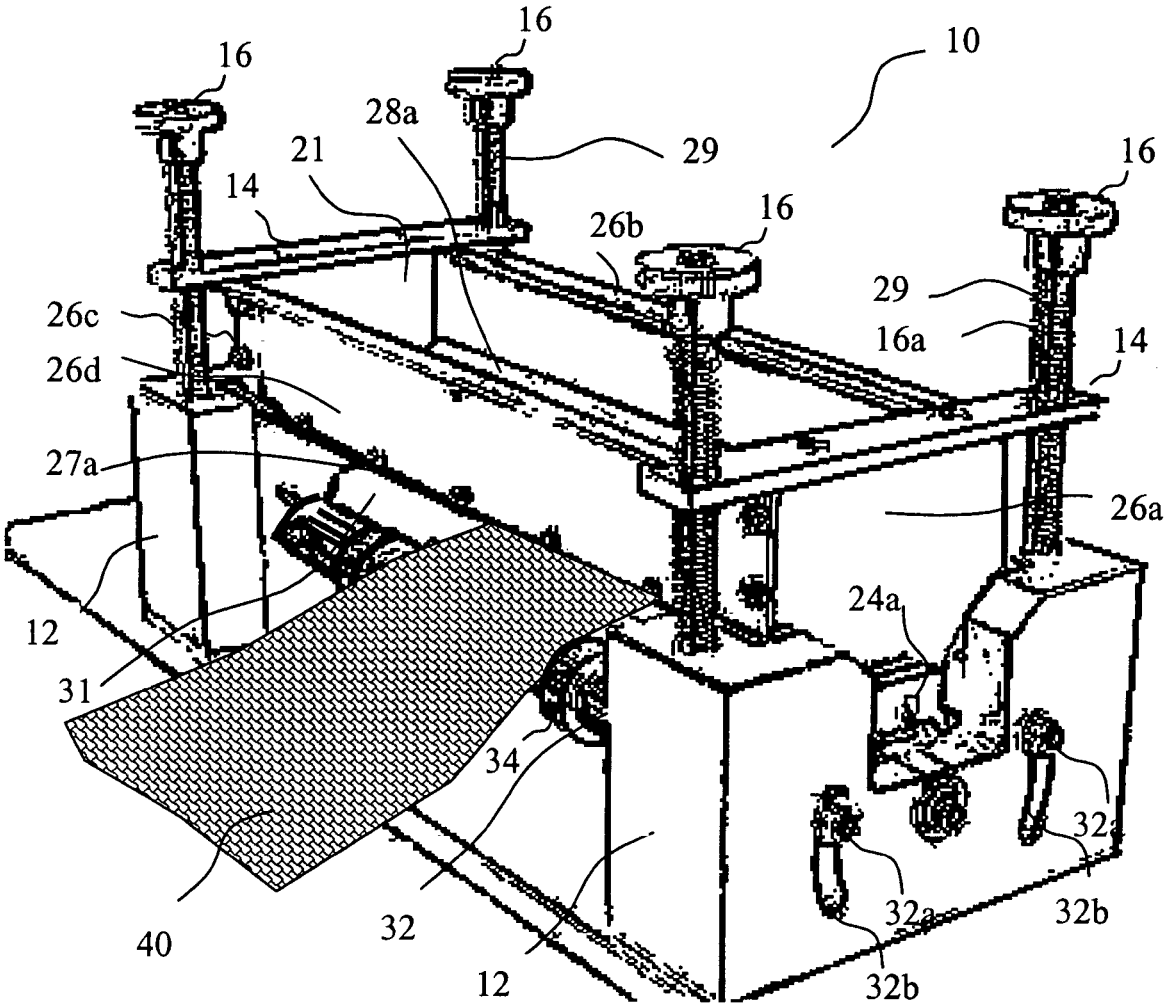

A further subject of the invention is a method for coating a substrate with a fluid comprising the steps of (i) supply of a substrate (40) and of a fluid, (ii) application of the fluid to the substrate (40) and (iii) shearing of the fluid by the substrate (40) set in motion in relation to the fluid.

18 Claims, 4 Drawing Sheets

DEVICE AND METHOD FOR COATING

The invention relates to a novel device and a novel method for coating with fluid, particularly with yield point fluid.

The term "coating" means the application of a fluid or fluidized substance on a support or substrate and, by extension, the layer of the substance deposited as the coating itself. Adhesives such as solvent-based two-component reactive polyurethanes (PU2K) are frequently used for coating substrates such as woven or knitted strips. The coating causes a mechanical reinforcement of the substrate and finds various applications, such as weave binding, cropping of substrate plush loops, or cutting of the substrate.

Standard roll sizing machines are known with feed by overflow and recycling, like those used for the solvent-based PU2K adhesives. Also known are coating devices using a lip nozzle, as practiced for HMPURs (Reactive Hot-Melt Polyurethanes). However, these devices give rise to frequent production shutdowns due, for example, to clogging and to the need to drain and rinse the devices.

There is accordingly a need for a coating device which serves to resolve the problems described above.

The invention relates to a coating device comprising a coating tank with an opening and a coating roll, in which the roll faces the opening.

In preferred embodiments, the invention comprises one or a plurality of the following features:

- a space is arranged between the tank and the coating roll, preferably between 0.1 and 7 mm;
- at least one drawer slides in the device;
- the device comprises means for returning the coating tank to an operating position;
- the device comprises at least one substrate guide roll with, if necessary, guide rollers;
- the device comprises means for positioning the guide roll along an axis, optionally offset from the axis of rotation of the guide roll;
- the device further comprises an oven;
- the device further comprises a substrate spooling reel.

The invention also relates to a method for coating a substrate with a fluid comprising the steps of: (i) supply of a substrate and of a fluid, (ii) application of the fluid to the substrate and, (iii) shearing of the fluid by the substrate set in motion in relation to the fluid.

In preferred embodiments, the invention also comprises one or a plurality of the following features:

- the method further comprises a step (iv) of at least partial stretching of the substrate, concomitant with the fluid shearing step;
- the substrate supplied in step (i) is a meshed substrate and step (iv) is a step of stretching the substrate meshes;
- the properties of the fluid supplied comprise at the time of step (ii): a Brookfield viscosity at 23° C. between 100 and 200,000 mPa·s, preferably between 200 and 4,000 mPa·s, a yield point between 1 and 5,000 Pa, preferably between 10 and 500 Pa, and a yield point time lag adjusted between 1 and 20 seconds, preferably between 2 and 10 seconds;
- the fluid supplied is a two-component reactive polyurethane adhesive, which comprises a resin portion comprising at least one polyol and one polyamine, and a hardener portion comprising at least one isocyanate;
- the method further comprises a step (v) of heating of the substrate;
- the method further comprises a step (vi) of winding of the substrate;
- the method uses a coating device according to the invention.

The invention also relates to a coated substrate which can be obtained by the substrate coating method according to the invention. In a preferred embodiment, the substrate is a self-clinging textile.

Figure 2:
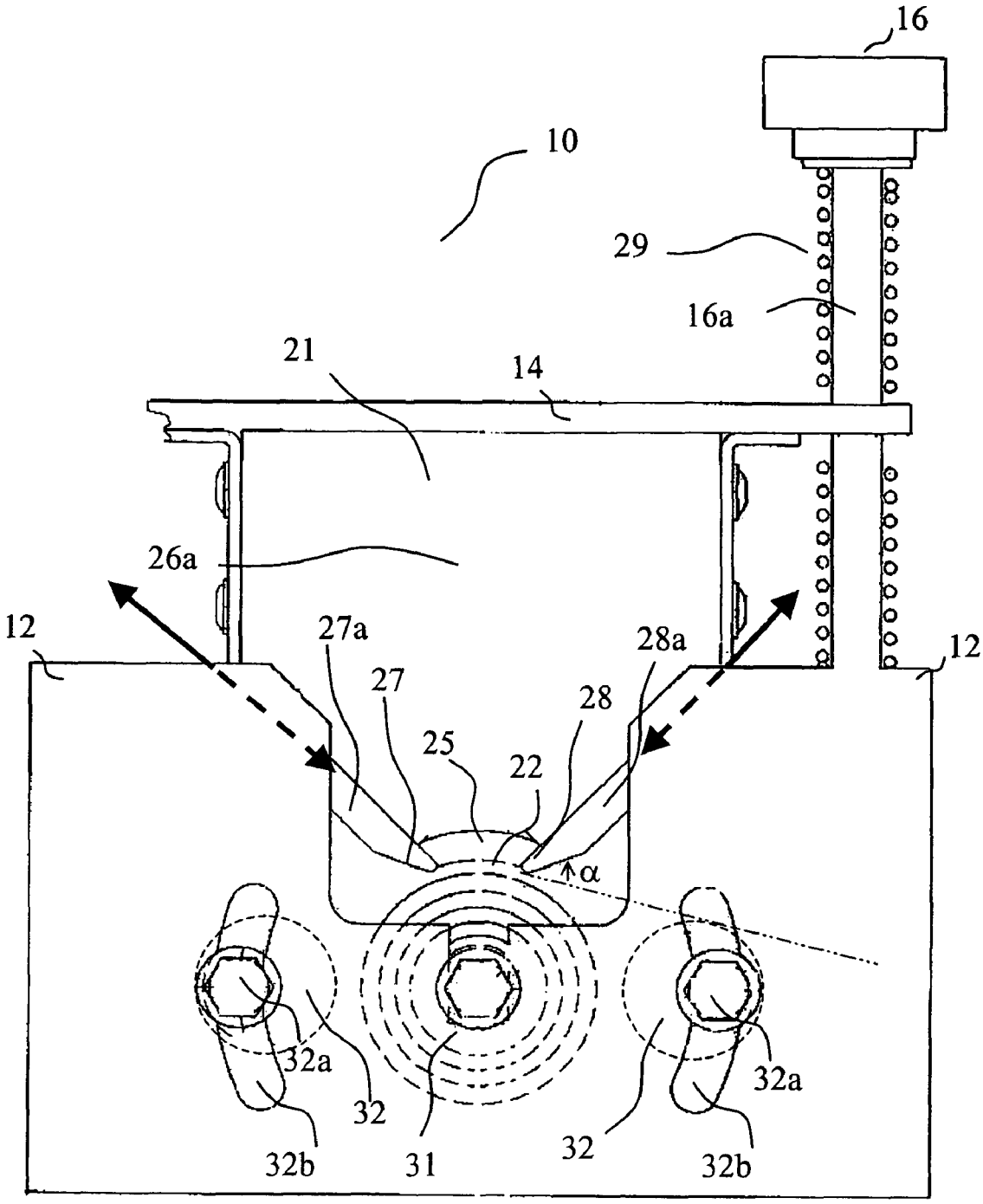
Figure 3:
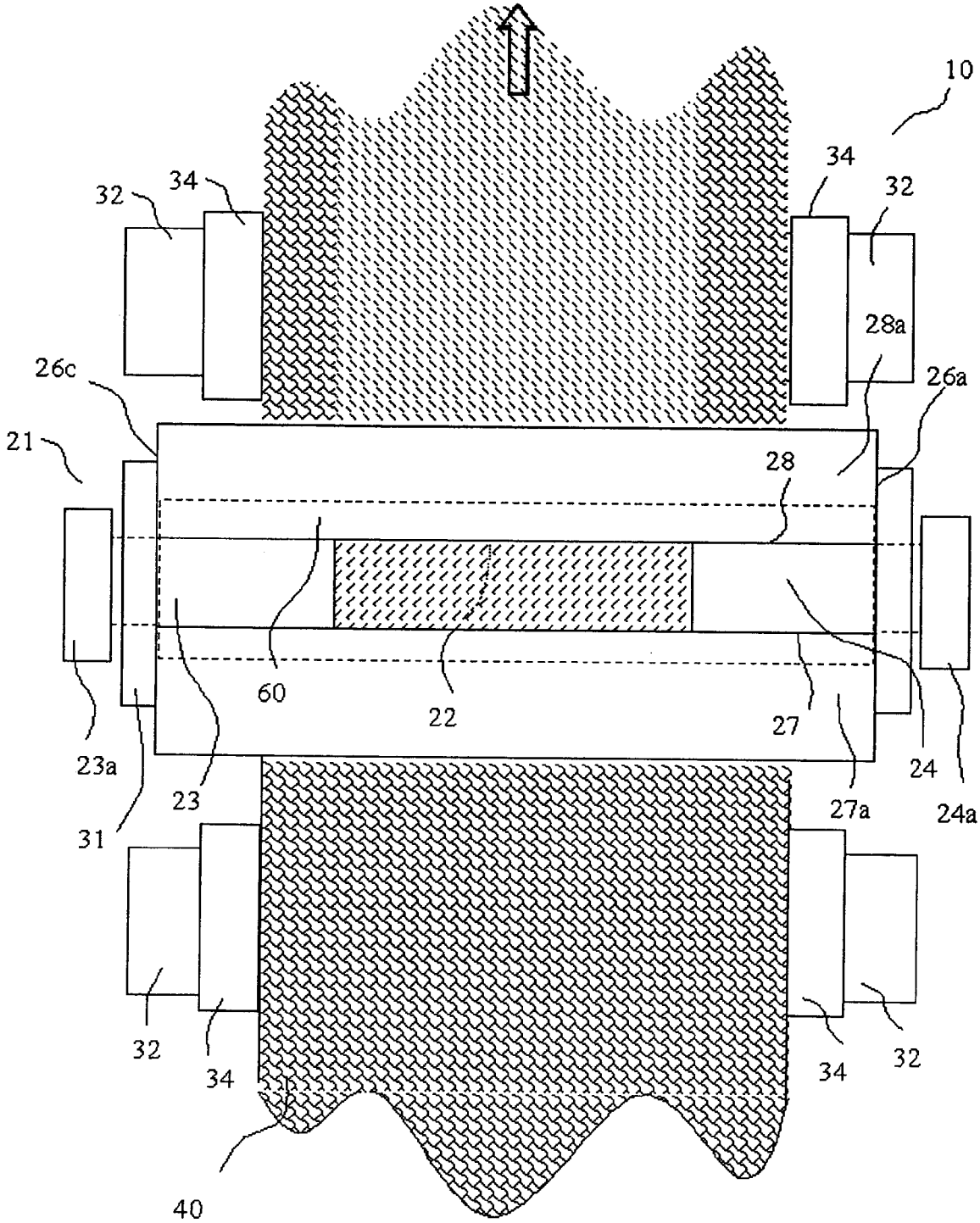
Figure 4:
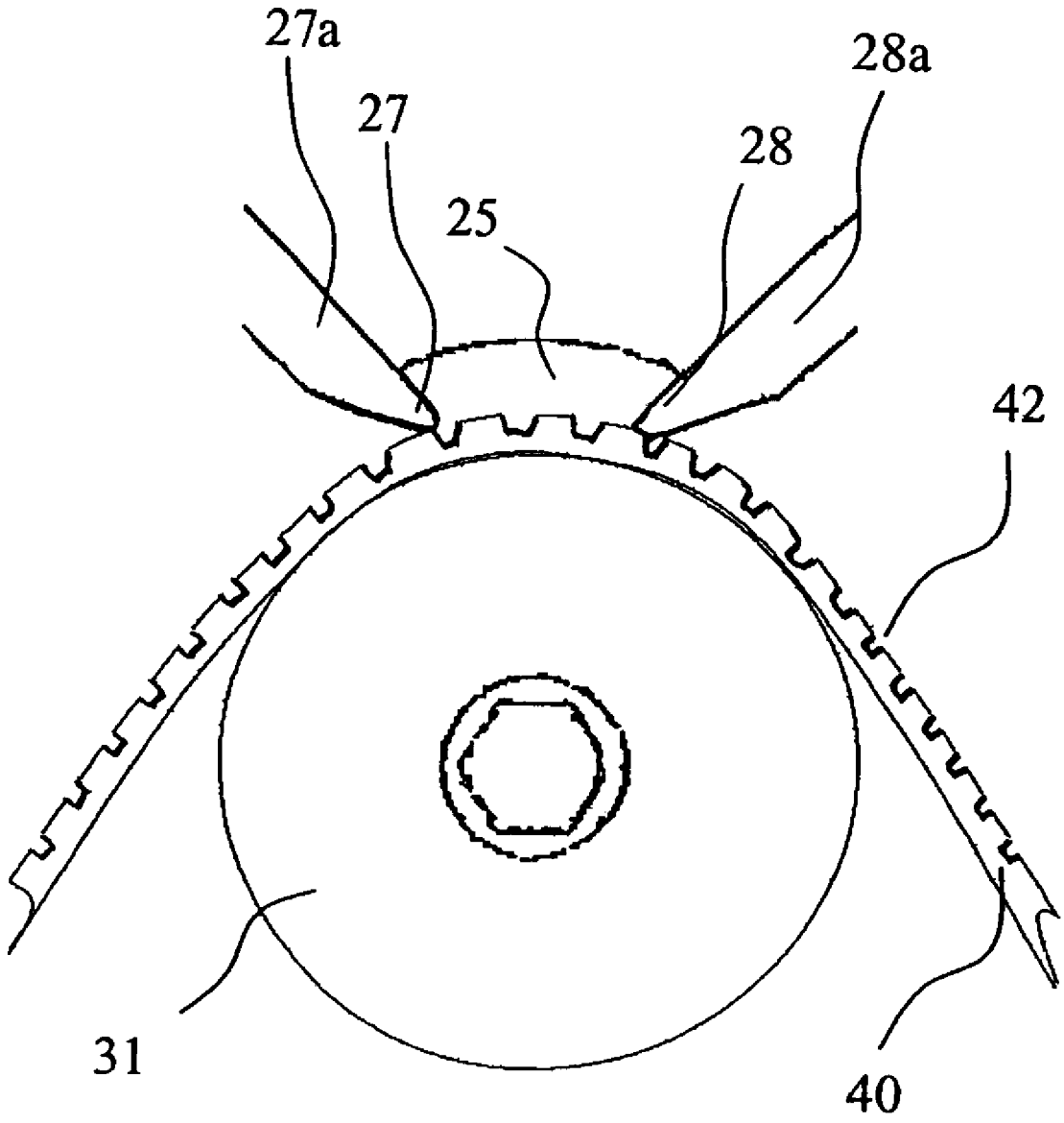

Other features and advantages of the invention will appear on a reading of the following description of preferred embodiments of the invention, given as examples and with reference to the drawings appended hereto showing:

FIG. 1: a perspective view of a coating device according to the invention;

FIG. 2: a side view of a coating device according to the invention;

FIG. 3: a plan view of a portion of a coating device according to the invention; and FIG. 4: a schematic illustration of a substrate inserted into a coating device according to the invention, seen in profile.

The invention proposes a coating device comprising a coating tank, with an opening, and a coating roll, in which the roll faces the opening.

The coating tank is able to receive a substance to be applied on a substrate. The opening has a size that is smaller or equal to the area of roll facing the tank. A fluid, for example a yield point adhesive, can be introduced into the coating tank. A substrate, for example a textile strip, can be inserted between the roll and the opening, the back of the substrate (that is the side to be coated) facing the opening.

Under the action of gravity or of any appropriate means for pressurizing the fluid, the fluid is applied to the substrate. When the substrate is set in motion in relation to the fluid, it exerts a shear stress on a layer of the fluid, for example a lower horizontal layer when the fluid is applied to the substrate under the action of gravity. When the yield point fluid is subjected to sufficient shear stress by the substrate strip, it can flow and accordingly coat the substrate.

Such a device allows the coating of the strip with good penetration of the fluid into the substrate. The substrate can simultaneously be subjected to a stretching at the level of the coating roll, thereby improving the penetration of the fluid. The use of this device with a fluid presenting both a yield point and a rapid cohesion build-up further allows a good penetration into the substrate, for example in the weft of a textile, without necessarily passing through it. It is further possible to jointly adjust the speed of advance of the strip and the physicochemical properties of the fluid in order to achieve precise control of the weight of adhesive deposited and, thereby, the properties of the substrate suitable for various applications (weave binding, substrate plush loop cropping, longitudinal cutting, cross cutting with trimmer, ultrasonic butt welding and binding or stiffening of the selvedges). Moreover, the use of a coating roll gives better coating results than a conventional device using a lip nozzle. In particular, thanks to the invention, a tighter and brighter coating is obtained.

FIG. 1 shows a perspective view of an example of a coating device according to the invention, using gravity and as a means for applying the fluid to the substrate. The device 10 comprises a coating tank 21 bounded, in its upper portion, by four sides 26*a*,26*b*,26*c*,26*d*. These sides can advantageously be made of polytetrafluoroethylene, considering the resistance to chemical substances, the thermal stability and the low friction coefficient of this substance. In its lower portion, the tank 21 comprises an opening 22 formed by the ledges 27, 28 of two other sides 27*a*, 28*a*, which will be described with reference to FIGS. 2 and 3. Under its bottom opening 22, the coating device 10 further comprises a coating roll 31 facing the opening 22, under said opening, and the width of which is generally between 20 and 60 cm. However, the width of the roll is not limited in theory; it is in practice, because of the risks of mechanical deformation of the roll (buckling). The diameter of the roll is preferably less than 100 mm and even more preferably between 30 and 50 mm.

Thanks to this device 10, an adhesive can be introduced into the coating tank 21 and a strip of substrate 40 can be inserted between the roll 31 and the bottom opening 22, through a space arranged for this purpose and, if need be, adapted to the thickness of the strip (relief included). The space arranged between the roll 31 and the bottom opening 22 is typically between 0.1 and 7 mm, depending on the coating weight desired. For example, arranging a space of about 5 mm, corresponding to a substrate thickness with its relief, serves to obtain a coating weight between 50 and 5,000 g/m$^2$, depending on the crushing resistance of the relief. The face of the substrate 40 to be coated is placed on the side of the opening 22. Under the action of gravity, the adhesive is applied to all or part of the strip, the opening having dimensions smaller than or equal to those of the roll.

Such a device is ideal for implementing a method for coating a substrate with a fluid, according to the invention. Such a fluid can, for example, be a yield point fluid, preferably without solvent. The method according to the invention comprises the steps: of supply of a substrate and of a fluid; of application of the fluid to the substrate; and of shearing of the fluid by the substrate set in motion in relation to the fluid.

The method according to the invention therefore proposes to apply the fluid to a substrate and to exert a shear stress on this fluid. When the shear stress is sufficient to overcome the yield point of this fluid, the fluid can flow and correctly wet the substrate. When the shear stress again falls below the yield point (for example when the stress is released), the fluid no longer flows.

It is therefore possible to achieve a coating of a substrate, which correctly wets this substrate without necessarily passing through it, and, by adjusting the shear stress, its time of occurrence, and the fluid application time.

The coating method according to the invention can further comprise a step of stretching of the substrate 40 (that is an opening of the relief of the meshes 42 of the substrate, as applicable) at least partially concomitant with the fluid shearing step, in order to improve the shearing of the fluid by the substrate as well as the penetration of the fluid into the substrate.

The device and the method according to the invention are ideal for use with a yield point fluid such as a fluid of which the viscosity, measured using a standard Brookfield viscometer at 23° C., is between 100 and 200,000 mPa·s, preferably between 200 and 4,000 mPa·s, with a yield point between 1 and 5,000 Pa, preferably between 10 and 500 Pa and a yield point time lag adjusted between 1 and 20 seconds and preferably between 2 and 10 seconds. Such a fluid profile allows easy pumping.

The fluid can both present a yield point and a Newtonian behaviour once the yield point is crossed, and remain ideal for use with the device according to the invention. In fact, even if it is particularly ideal for yield point fluids, the device according to the invention is also compatible with a wide range of fluids without yield point, that is having a yield point lower than 1 Pa, but presenting an appropriate viscosity between 100 and 200,000 mPa·s.

In particular, the device and the method are ideal for the application of a two-component reactive polyurethane adhesive (PU2K), comprising a resin portion comprising at least one polyol and one polyamine, and a hardener portion comprising at least one isocyanate. Such a reactive mixture is likely to present a yield point. It can further advantageously be used without solvent, that is having a solvent content of less than 1% and, preferably, less than 500 ppm by weight, in the device according to the invention.

The driving of the strip of substrate 40 around the roll 31 leads to a shearing of the fluid by the substrate. A sufficient shearing of an adhesive presenting a profile as described above increases the fluidity of this adhesive at the level of the bottom opening, giving rise to a correct wetting of the fibres of the substrate.

The passage of the strip on the roll 31 can further lead to a stretching of the substrate 40 (that is an opening of the relief or the meshes 42 of the substrate, as applicable), on the coating face side. The scale of this stretching varies in particular as a function of the diameter of the roll 31 and the angles formed by the substrate on either side of the roll 31: the terms of arrival and escape angles are used according to whether one is situated downstream or upstream of the roll 31, respectively. This stretching is at least partially concomitant with the shearing of the adhesive, thereby improving the wetting of the substrate fibres by the adhesive.

In this respect, it may be observed that, according to one embodiment, the desired diameter of the coating roll 31 is as small as possible, in order to permit a maximum stretching of the substrate 40, insofar as this diameter does not cause any significant buckling of the roll. A roll diameter between 30 and 50 mm serves to optimize the stretching of the substrate 40. In practice, a diameter of 40 mm proves to be ideal for the stretching of substrates of various types. The stretching of the substrate 40 is absorbed just after the passage on the coating roll 31, while the adhesive recovers its cohesiveness after the shearing. The use of such a device 10 with an adhesive presenting both a yield point and a rapid cohesion build-up improves the penetration of the fluid into the substrate without necessarily passing through it. The forward speed of the strip can further be adjusted (1 to 200 m/min, preferably 10 to 50 m/min) jointly with the physicochemical properties of the adhesive to permit an accurate control of the weight of adhesive deposited, for example between 10 and 500 g/m$^2$, depending on the relief of the support. Such an adjustment further serves to obtain varied properties, depending on the intended application, such as weave binding, substrate plush loop cropping, longitudinal or cross cutting by trimmer, ultrasonic butt welding and selvedge binding or stiffening. The coating device according to the invention is further particularly ideal for coating self-clinging textiles. Moreover, the use of a coating roll 31 gives better coating results than a conventional device using a lip nozzle. In particular, thanks to the invention, a tighter and brighter coating is obtained. Furthermore, the device 10 according to the invention does not give rise to frequent production shutdowns, even if it is used with adhesives having a rapid cohesion build-up.

Other elements 32,32*a*,32*b*,34 of FIG. 1 will be described with reference to FIG. 2.

FIG. 2 shows a side view of a coating device 10 according to the invention. This view shows the ledges 27, 28 of the sides 27*a*, 28*a*, defining the bottom opening 22 of the tank 21, under which the roll 31 is located. The sides 27*a*, 28*a* can be inclined, so that the tank 21 presents a funnel shaped section, with its cone angle adapted to facilitate the flow of the fluid. However, another type of cross section, for example rectangular, could also be suitable.

It can also be advantageous to provide a coating device 10 further comprising one or two mobile sides 27*a*, 28*a*. In particular, the sides 27*a*, 28*a* can slide in the direction of the arrows shown in FIG. 2. This makes it possible to adjust the space arranged between the tank and the coating roll, as a function of the thickness of substrate and/or jointly with the physicochemical properties of the adhesive, in order to obtain specific properties of the strip of substrate 40 (see above).

It may also be advantageous to provide a coating device 10 in which the cross section of the ledges 27, 28 takes the form of a point rounded at its tip (the circle of curvature at the tip of a ledge has a diameter typically between 0.5 and 15 mm), in order to promote the sliding of the strip and avoid any engagement with it when it is driven on the roll. The profile of the ledges 27, 28 of the example of the device shown in FIG. 2 results from a compromise between their machinability (the ledges in this example are made of a metallic material) and the desired angle of escape $\alpha$. The angle corresponding to the point, in cross section, is typically between 20° and 40°. It may however be adapted in order to arrange an angle of escape $\alpha$ greater than the wetting angle of the fluid in order to prevent the accumulation of fluid against a ledge. This serves to lengthen the continuous operating time of the device before interruption for cleaning, and hence to decrease the frequency of production shutdowns.

It is further advantageous to be able to cause at least one drawer 23, 24 to slide in the device 10. for example, it is possible to provide a passage 25 arranged in at least one side 26 in order to cause one or more drawers 23, 24 to slide along the groove formed by the ledges 27, 28, from the exterior of the device 10 thanks to gripping means of the drawers 23*a*, 24*a*. This possibility is described with reference to FIG. 3.

Furthermore, return means 29 can be provided to position the coating tank 21 against the coating roll 31 via the ledges 27, 28 or against the strip, when the latter is inserted. However, when it is advisable to arrange a space between the tank 21 and the coating roll 31, these means 29 are adapted in order to return the tank 21 to an operating position. This operating position leaves a free space between the tank 21 and the coating roll 31. In the example shown in the figure, the return means 29 comprise one or a plurality of coil springs. If necessary, the springs can be in contact with the surfaces of the support 12, of a flat 14 and of a sleeve 16. This sleeve can if necessary be adjustable, that is, it can be screwed to a rod 16*a* to adjust the return force of the spring. The preceding assembly also serves to adjust the operating position of the tank 21 (in particular the height of the tank, the pitch and roll angles), to dampen the vibrations of the system (for example during the passage of butt joints of the substrate strip) and to relieve the occasional stresses generated by the movement of the substrate strip 40.

It may also be advantageous to provide one or a plurality of guide rolls 32 for the substrate strip 40, as in the example of the device 10 shown in FIG. 2. The substrate can be inserted below or above a guide roll, depending on the desired angle of arrival and/or of escape. These angles are those formed between the upper surface of the substrate and the bottom surface of a ledge 27, 28. The wetting angles of the fluids used typically vary between 15 and 40°. The figure also shows positioning means 32*a*, 32*b* of the guide roll. In this example, these means comprise a nut 32*a* screwed to the shaft of a guide roll 32 and pressing a washer in support against a kidney piece 32*b*. The nut 32*a* thereby serves to adjust the position of the shaft of the guide roll 32 located on one side of the coating roll 31. Similar positioning means can be provided on the opposite side of the coating roll 31 in order to permit an adjustment of the position of another guide roll 32. A roll 32 can, for example, be provided with rollers 34, of which the spacing can be adjusted to the width of the substrate, in order to guide the substrate strip 40 through the coating device 10.

It is further possible to provide a convex-shaped guide roll, that is of which the outer surface has a uniform and slightly convex curvature in a plane containing the axis of the roll, to permit the guiding and centering of the substrate.

It is further possible to provide positioning means 32*a*, 32*b* along an axis offset from the shaft of the roll 32, as in the example shown in FIG. 2. Although optional, offset positioning means make it possible to cover a wider range of arrival and/or escape angles of the substrate on the coating roll 31. Thus, these means serve to adjust the angle of arrival and/or of escape of the substrate, and to do this more accurately than with a non-offset mechanism. These angles are preferably adjusted to a value greater than that of the wetting angle of the fluid employed, in order to prevent the accumulation of fluid and, thereby, decrease frequency of production shutdowns.

The position of a roll 32 can, if necessary, be adjusted in particular in height to stretch the substrate strip 40 (the substrate in this case being inserted under the roll 32), while guiding it, in order, for example, to optimize the stretching of the substrate 40 during its passage at the level of the opening 22.

FIG. 3 shows a schematic plan view of a portion of a coating device 10, not to scale. More particularly, the figure shows sides 27*a*, 28*a* of the coating tank 21, of which the ledges 27, 28 define the opening 22. The length of the opening (that is, along the substrate travel direction) is typically between 10 and 50 mm. Drawers 23, 24 are inserted into the opening thus defined, in which they can slide. Other sides 26*a*, 26*c* of the tank 21 are shown in the figure. The drawers terminate in gripping means 23*a*,24*a*, able to manipulate the drawers outside the coating device 10. These gripping means 23*a*, 24*a* can comprise fixing means, such as locking screws or micrometric adjusting screws, to secure the positioning of the drawers 23, 24. The outer portions of the drawers are shown by dotted lines: the length of these portions can be adapted according to the desired degree of obstruction of the opening 22 by the drawers 23, 24. In particular, a length of the drawers can be provided such as to permit a total obstruction of the opening 22. It is thus possible to obtain a removable tank, which makes use, substrate change and cleaning easier. It should be noted that the same result can be obtained using a single drawer. The figure also shows a substrate strip 40 inserted into the device 10, that is, under the tank 21 and above the roll 31 (not shown). The motif symbolizes the side of the face of the substrate to be coated. A fluid 60 partially fills the tank 21, its contours being bounded by dotted lines. For the sake of clarity, a translucent fluid 60 is shown. The position of the fluid contours at the level of the sides 27*a*,28*a* is explained by the fact that these sides 27*a*,28*a* are inclined, in the embodiment shown in the figure. The presence of the fluid 60 in the tank 21 partly obscures the motif of the substrate 40 visible under the opening 22. Also shown in FIG. 3 are: the coating roll 31 and two guide rolls 32 equipped with rollers 34 for guiding the substrate 40, adjusted to the width of the substrate.

Thus, the use of drawers 23, 24 serves to control the width of the surface to be coated. After its passage under the opening 22, the substrate 40 is partially coated on an area corresponding to the width bounded by the drawers 23, 24. The coated surface of the substrate is symbolized by a motif altered in comparison with the motif of the substrate 40 before coating.

A "variable geometry" tank 21 is thereby obtained according to the invention. It is further possible to vary the geometry of the tank 21 jointly with the physicochemical properties of the adhesive, in order to obtain specific properties of the substrate strip 40.

The device 10 described above can further be able to operate in both substrate travel directions. This is the case of the device or portions of device shown in FIGS. 1 to 4. For this purpose, a certain symmetry of the device can be imposed about the coating roll, particularly with respect to the cross section and orientation of the ledges 27, 28 (as shown in FIGS. 2 and 4), and the guide rolls (see in particular FIGS. 2 and 3). This alternative makes it possible, for example, to cause the substrate strip to travel through the device 10 while adjusting the settings of the device (such as the angles of arrival/of escape and the tank height), and then to cause the strip to travel in the opposite direction, once these settings have been completed. Thus several meters of substrate strip can be economized, which is very advantageous since the substrate is costly.

Furthermore, once the substrate strip is coated, it can be sent to an oven. Typically, the length of the oven is between 1 and 20 meters, its temperature varies between 50 and 250° C., and the relative humidity is between 0 and 80%. The passage of the substrate can also be scaled down in the oven, in order to economize the oven length. The speed of the substrate strip 40 can reach 60 meters per minute inside the oven. During its passage through the oven, the adhesive can, depending on its composition, recover fluidity (at least temporarily) and thereby improve the wetting. The parameters mentioned above can be adjusted so that a mechanical adhesion occurs without the adhesive actually passing through the support. Simultaneously, the cohesiveness of the adhesive can increase rapidly under the effect of the temperature, which promotes chemical conversion. For example, the chemical conversion rate obtained with a two-component polyurethane adhesive as described above can be more than 98% at the oven exit. This is accordingly sufficient to permit a winding of the substrate strip 40 without release paper, and without strip blocking effects.

Furthermore, the device 10 can also advantageously comprise a substrate spooling reel. In relation to a strip travel direction (shown by an arrow in FIG. 3), a spooling reel can be positioned downstream of the coating roll 31 and, if necessary, upstream of one or a plurality of drive rolls 32 and downstream of an oven. The rotation of the spooling reel can suffice in itself to set the strip in motion along its travel route. This does not necessarily preclude reliance on independent drive means for each of the rolls 31, 32 involved in the device 10, particularly if it is desirable to exert a tension on the strip.

Thus, the invention significantly improves the underside coating of substrates and can be implemented with substrates presenting a wide variety of textures. The substrates which could be suitable include, for example, brushed yarn substrates, release papers, plastic films, in particular of polyester, polyamide, polypropylene and polyethylene, metallic films or plastic films comprising metalized wires, glass fabrics, films with wood veneer, natural fibre fabrics (for example with cotton fibres), antistatic fabrics, artificial textile materials based on cellulose (for example rayon), and synthetic or natural non-woven fabrics.

FIG. 4 shows a partial profile view of a substrate 40 inserted into a coating device according to the invention. The substrate 40 inserted between the coating roll 31 and the ledges 27, 28 of the coating tank presents a texture 42 (or relief) of any origin (for example due to weave meshes or fibres) symbolized by notches. In the example in the figure, the substrate 40 is stretched downstream and/or upstream of the device and the ledges are flush with the substrate. The mechanical stress exerted by the roll 31 in particular on the substrate causes a spacing of the motifs or, indeed, an opening of the relief forming the texture of the substrate. This spacing or opening can not only improve the shearing of the fluid applied to the substrate, but also enables the fluid to penetrate the texture better, that is, to wet the substrate better.

Last, the height of fluid above the substrate can be regulated, especially at the level of the coating tank, this fluid height creating an hydrostatic pressure favoring wetting and impregnating, which result is not possible to obtain with a blade.

The invention is nonetheless not limited to the variants described above, but is susceptible to numerous other variations readily accessible to the person skilled in the art. In particular, one possible variant comprises the use of a plurality of coating tanks 21 and rolls 31 for the successive coating of a substrate strip 40 by various fluids. Another variant concerns transfer coating, that is a method by which a coating layer is applied to a temporary support (for example release paper), to which a binding product can be added later, to ultimately permit the transfer of the coating layer, for example, by means of a roll, to a final support such as a metal sheet or any other support unfit for direct coating.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosure[s] of all applications, patents and publications, cited herein and of corresponding French application No. 0307969, filed Jul. 1, 2003 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A method for coating a substrate with a fluid comprising:

(i) supplying a meshed substrate and a fluid;

(ii) applying said fluid to said meshed substrate using a coating device comprising:

a coating tank with an opening; and a coating roll, the roll facing said opening;

(iii) shearing said fluid by said meshed substrate being set in motion in relation to said fluid, said meshed substrate being set in motion between the roll and the opening thereby applying said fluid to said meshed substrate; and (iv) stretching the meshes of said meshed substrate, wherein the stretching occurs at least partially concomitant both with said fluid applying and with said fluid shearing.

2. A method for coating a substrate according to claim 1, in which the properties of said fluid at the time of (ii) comprise:

a Brookfield viscosity at 23° C. between 100 and 200,000 mPa·s;

a yield point between 1 and 5,000 Pa; and a yield point time lag adjusted between 1 and 20 seconds.

3. A method for coating a substrate according to claim 2, wherein at the time of (ii) said fluid has a Brookfield viscosity at 23° C. between 200 and 4,000 mPa·s.

4. A method for coating a substrate according to claim 2, wherein at the time of (ii) said fluid has a yield point between 10 and 500 Pa.

5. A method for coating a substrate according to claim 2, wherein at the time of (ii) said fluid has a yield point time lag adjusted between 2 and 10 seconds.

6. A method for coating a substrate according to claim 1, in which the properties of said fluid at the time of (ii) comprise:

a Brookfield viscosity at 23° C. between 200 and 4,000 mPa·s;

a yield point between 10 and 500 Pa; and a yield point time lag adjusted between 2 and 10 seconds.

7. A method for coating a substrate according to claim 1, in which the fluid supplied is a two-component reactive polyurethane adhesive, which comprises a resin portion comprising at least one polyol and one polyamine, and a hardener portion comprising at least one isocyanate.

8. A method for coating a substrate according to claim 7, wherein the amount of said adhesive coated onto said meshed substrate is between 10 and 500 g/m$^3$.

9. A method for coating a substrate according to claim 1, further comprising heating said substrate.

10. A method for coating a substrate according to claim 1, further comprising winding said substrate.

11. A method according to claim 1, in which the space between the coating roll and the opening of the tank is between 0.1 and 7 mm.

12. A method according to claim 1, wherein said coating device further comprises at least one substrate guide roll, with, optionally, guide rollers.

13. A method according to claim 12, wherein said coating device further comprises means for positioning said guide roll along an axis, optionally offset from the axis of rotation of said guide roll.

14. A method according to claim 1, further comprising an oven.

15. A method according to claim 1, further comprising a substrate spooling reel.

16. A method for coating a substrate according to claim 1, wherein said meshed substrate is set in motion at a speed of 1-200 m/min.

17. A method for coating a substrate with a fluid comprising:

(i) supplying a meshed substrate and a fluid;

(ii) applying said fluid to said meshed substrate using a coating device comprising:

a coating tank with an opening; and a coating roll, the roll facing said opening;

(iii) shearing said fluid by said meshed substrate being set in motion in relation to said fluid, said meshed substrate being set in motion between the roll and the opening thereby applying said fluid to said meshed substrate; and (iv) at least partial stretching the meshes of said meshed substrate during application of the fluid thereto, and concomitant with the fluid shearing;

and in which the fluid supplied is a two-component reactive polyurethane adhesive, which comprises a resin portion comprising at least one polyol and one polyamine, and a hardener portion comprising at least one isocyanate, and the two-component adhesive has the following properties, at the time of (ii):

a Brookfield viscosity at 23° C. between 200 and 4,000 mPa·s;

a yield point between 10 and 500 Pa; and a yield point time lag adjusted between 2 and 10 seconds.

18. A method for coating a substrate according to claim 17, further comprising heating said substrate.

* * * * *

UNITED STATES PATENT AND TRADEMARK OFFICE

CERTIFICATE OF CORRECTION

PATENT NO. : 7,749,571 B2
APPLICATION NO. : 10/882102
DATED : July 6, 2010
INVENTOR(S) : Chartrel It is certified that error appears in the above-identified patent and that said Letters Patent is hereby corrected as shown below:

Column 9, claim 11 reads "A method according to claim 1, in which the space between the coating roll and the opening of the tank is between 0.1 and 7mm." Should read -- A method according to Claim 1, wherein a space is provided between the coating roll and the opening of the tank which is between 0.1 and 7mm. --

Signed and Sealed this

Ninth Day of November, 2010

David J. Kappos

David J. Kappos
*Director of the United States Patent and Trademark Office*